US005427881A

United States Patent [19]

Sacripante et al.

[11] Patent Number: 5,427,881

[45] Date of Patent: Jun. 27, 1995

[54] CROSSLINKED POLYESTERIMIDE TONER COMPOSITIONS

[75] Inventors: Guerino G. Sacripante, Oakville; B. W. Anissa Yeung, Mississauga; Stephan V. Drappel, Toronto, all of Canada

[73] Assignee: Xerox Corporation, Stamford, Conn.

[21] Appl. No.: 190,437

[22] Filed: Feb. 2, 1994

[51] Int. Cl.[6] ..... G03G 9/087

[52] U.S. Cl. ..... 430/109; 430/126; 430/110

[58] Field of Search ..... 430/110, 105, 107, 109, 430/126

[56] References Cited

U.S. PATENT DOCUMENTS 4,513,074 4/1985 Nash et al. ..... 430/106.6
4,543,313 9/1985 Manabadi et al. ..... 430/109
4,560,635 12/1985 Hoffend et al. ..... 430/106.6
4,745,030 5/1988 Arahara et al. ..... 428/421
4,780,742 10/1988 Takahashi et al. ..... 430/124
5,238,768 8/1993 Ong ..... 430/110
5,266,429 11/1993 Sorriero et al. ..... 430/58

OTHER PUBLICATIONS

Encyclopedia of Polymer Science and Engineering, vol. 12, 2nd Edition, Published by Wiley, (1985), pp. 364 to 383.

Advances in Polyimides Science in Technology, Edited by Claudius Feger et al., Published by Technomic Publishing (1993).

*Primary Examiner*—John Goodrow
*Attorney, Agent, or Firm*—E. O. Palazzo

[57] ABSTRACT

A toner composition comprised of a pigment, and a crosslinked polyesterimide.

22 Claims, No Drawings

CROSSLINKED POLYESTERIMIDE TONER COMPOSITIONS

BACKGROUND OF THE INVENTION

This invention is generally directed to toner and developer compositions, and more specifically, the present invention is directed to developer and toner compositions containing novel crosslinked polyesterimide resins, and reactive extrusion process for the preparation thereof. In embodiments, there are provided in accordance with the present invention toner compositions, especially low melting and broad fusing latitude toner compositions, comprised of certain crosslinked polyesterimide resins and pigment particles comprised of, for example, carbon black, magnetites, or mixtures thereof, cyan, magenta, yellow, blue, green, red, or brown components, or mixtures thereof thereby providing for the development and generation of black and/or colored images. In embodiments, there are provided in accordance with the present invention unsaturated polyesterimide resins of the following formula which resins are selected for the preparation of the crosslinked polyimides

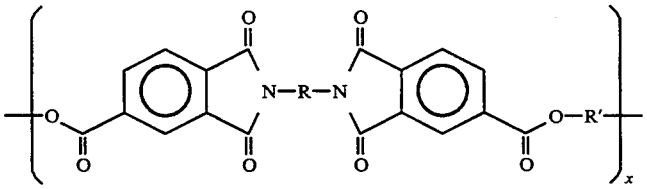

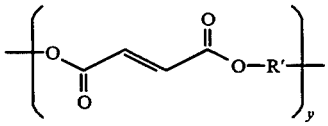

wherein x and y represent the number of random repeating segments and can be a number of from about 10 to about 10,000, and preferably up to about 1,000; R′ is an alkyl group with from about 1 to about 25 carbon atoms; and R is an alkyl group, oxyalkylene or polyoxyalkylene. The aforementioned unsaturated polyesterimides are then reacted with free radical initiators such as, for example, with peroxides such as benzoyl peroxide and the like to yield crosslinked polyesterimides. Processes for the preparation of the toners of this invention include reactive extrusion process wherein the aforementioned unsaturated polyimide resin is admixed with peroxides, such as benzoyl peroxide, in an amount of from about 0.1 percent to about 3 percent by weight of unsaturated polyesterimide, and then extruded, for instance, utilizing a Davo Twin extruder operated at a barrel temperature of from about 140° C. to about 180° C., thereby converting the linear unsaturated polyimide to the desired crosslinked polyimide followed by the addition of pigment. The toner compositions of the present invention in embodiments possess a number of advantages including low melting characteristics, excellent blocking characteristics of above 120° F., possess excellent nonvinyl-offset properties, and low relative humidity sensitivity such as from about 1.2 to about 3.0. The unsaturated polyesterimides of the present invention can in embodiments be generated by the reaction of at least one alkylene diamine, such as branched JEF- FAMINES TM available from Texaco Chemicals as JEFFAMINE D-230 TM, D-400 TM, EDR-148 TM, EDR-192 TM, and are believed to be of the following formula

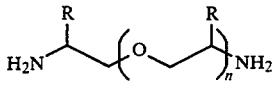

EDR-148 n=2;R=H
EDR-192 n=3;R=H
D-230 n=2,3; R=$CH_3$
D-400 n=5,6; R=$CH_3$

The aforementioned polyimides exhibit in embodiments a number average molecular weight of from about 3,000 grams per mole to about 30,000 grams per mole as measured by vapor phase osmometer, have a glass transition temperature of from about 45° C. to about 65° C., and more preferably of from about 50° C. to about 62° C. as measured by the Differential Scanning Calorimeter.

Examples of advantages of the toner composition of the present invention include low fusing temperatures, such as from about 115° C. to about 145° C., and therefore, lower fusing energies are required for fixing thus enabling less power consumption during fusing, and permitting extended lifetimes for the fuser system selected. Furthermore, the toner composition of this invention possesses in embodiments a broad fusing latitude, such as from about 30° C. to about 100° C., with minimal or avoidance of release oil, which inhibits the toner from offsetting onto the fuser rollers usually associated with ghosting or background images on subsequent copies. Additionally, the fused image obtained with the toner compositions of the present invention in embodiments does not substantially offset to vinyl covers, such as those utilized for notebook binders, and possess low humidity sensitivity ratio of from about 1 to about 2.3 as calculated by the ratio of the triboelectric charge in microcoulombs per gram of the developer after placed in a chamber of 20 percent humidity for 48 hours to the triboelectric charge in microcoulombs per gram of the developer after placed in a chamber of 80 percent humidity for 48 hours.

A number of toner resins are known, such as styrene acrylates, styrene methacrylates, polyesters, polyamides, and generally certain polyimides.

Certain polyimide and polyesterimide resins and, more specifically, linear polyesterimide resins are illustrated in U.S. Pat. No. 5,348,831, the disclosure of which is totally incorporated herein by reference. Specifically, the aforementioned copending application discloses linear polyesterimide resin useful for high gloss toner applications wherein glossy images of from about 50 to about 80 gloss units are obtained for certain printing or copying applications, especially wherein pictorial images are desired. The present invention's polyesterimides differ in that, for example, linear unsaturated polyimides are crosslinked to result in toner compositions comprised of a pigment and crosslinked polyimide which offer low gloss advantages such as from about 1 to about 30 gloss units thereby providing matte images desired for certain printing or copying applications, especially wherein matte highlight or black documents are desired. Furthermore, with the toners of the present invention other advantages, such as low fusing temperature and low humidity sensitivity, are retained.

Illustrated in the following copending applications, the disclosures of each being totally incorporated herein by reference, are:

U.S. patent application Ser. No. 144,075 illustrates a toner composition comprised of a pigment and a crosslinked polyimide; and wherein the crosslinked polyimide can be obtained from the reaction of a peroxide with an unsaturated polyimide of the formula

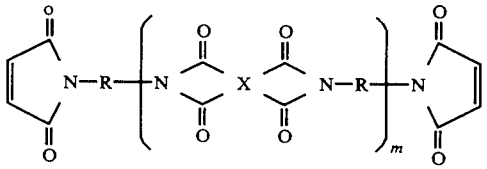

wherein X is

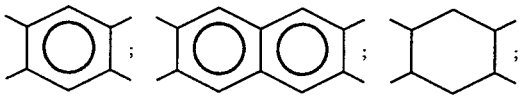

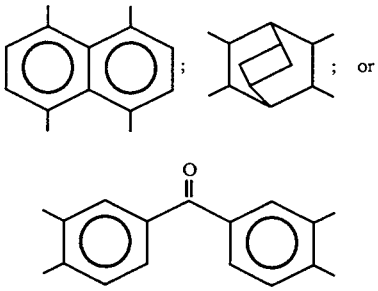

R is alkyl or oxyalkylene; and m represents the number of monomer segments present and is a number of from about 10 to about 1,000.

U.S. Pat. No. 5,348,830 illustrates a toner composition comprised of a pigment, and a thermotropic liquid crystalline polyimide of the formula

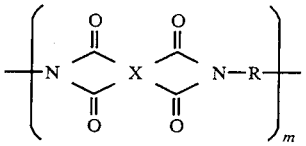

wherein m represents the number of monomer segments present; X is a symmetrical moiety independently selected from the group consisting of phenyl, naphthyl, cyclohexyl, or bicycloaliphatic; and R is independently selected from the group consisting of alkyl, oxyalkylene and polyoxyalkylene.

U.S. patent application Ser. No. 144,956 illustrates a toner composition comprised of pigment, and polyimide of the formula

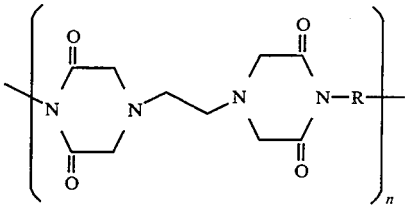

wherein n represents the number of monomer segments, and is a number of from about 10 to about 1,000; and R is alkyl, oxyalkyl, or polyoxyalkyl.

U.S. Pat. No. 5,348,831 illustrates a toner composition comprised of pigment, and a polyester imide resin of the formula

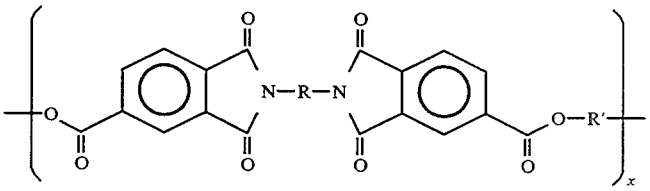

wherein n represents the number of segments present and is a number of from about 10 to about 10,000; R' is alkyl or alkylene; and R is independently selected from the group consisting of an oxyalkylene and polyoxyalkylene.

U.S. patent application Ser. No. 144,918 illustrates a toner composition comprised of pigment, and polyimide of the formula

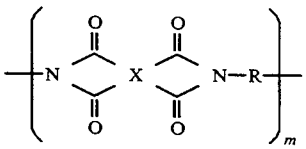

wherein m represents the number of monomer segments present; X is

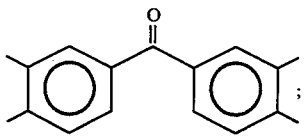

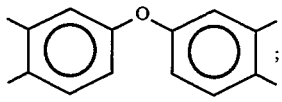

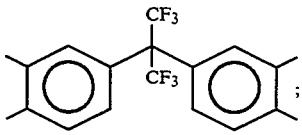

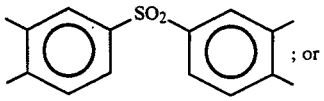

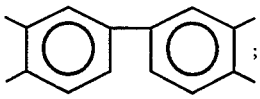

thus X can be benzophenone, oxydiphthalic, hexafluoropropane diphenyl, diphenyl sulfone, or biphenyl; X is attached to four imide carbonyl moleties; and R is independently selected from the group consisting of alkyl, oxyalkylene and polyoxyalkylene.

There are summarized and illustrated in the *Encyclopedia of Polymer Science and Engineering,* 2nd edition, Volume No. 12, published by Wiley (1985) other polyesterimides. Moreover, there are also disclosed in *Advances in Polyimides Science in Technology,* edited by Claudius Fegere et al., and published by Technomic Publishing (1993), unsaturated polyimides and certain crosslinked polyimides. However, these unsaturated and crosslinked imide resins are completely aromatic and useful as high performance materials, and there is no teaching therein relating to toners.

Also, in Eastman Kodak U.S. Pat. No. 5,266,429 there are illustrated charge transport (CTL) polyesterimide binders for photoreceptors.

SUMMARY OF THE INVENTION

It is an object of the present invention to provide toner and developer compositions with many of the advantages illustrated herein.

In another object of the present invention there are provided toner compositions with crosslinked polyesterimides, and which toners are useful for the development of electrostatic latent images including color images.

In yet another object of the present invention there are provided processes for the preparation of certain unsaturated polyesterimides by melt condensation methods.

In another object of the present invention there are provided toners with low melt fusing temperatures of from about 130° C. to about 145° C. and a broad fusing latitude of from about 30° C. to about 60° C.

Moreover, in another object of the present invention there are provided toner compositions comprised of crosslinked polyesterimides with a glass transition temperature of from about 50° C. to about 65° C.

In yet another object of the present invention there are provided unsaturated polyesterimides with a number average molecular weight of from about 3,000 grams per mole to about 30,000 and a weight average molecular weight of from about 10,000 grams per mole to about 200,000 gram per mole.

In yet in another object of the present invention there are provided developer compositions comprised of a crosslinked polyesterimide with number average molecular weight of from about 6,000 grams per mole to about 300,000 gram per mole as measured by vapor pressure osmometry.

Moreover, it is an object of the present invention to provide a toner which displays low gloss such as from about 1 to about 30 gloss units as measured by the Gardner Gloss metering unit.

Also, it is an object of the present invention to provide a toner which displays low relative sensitivity, such as from about 1.0 to about 2.3, as measured from the triboelectric charge ratio of 20 percent humidity level to 80 percent humidity level.

Another object of the present invention resides in the formation of toners which will enable the development of images in electrophotographic imaging apparatuses, which images have substantially no background deposits thereon, are substantially smudge proof or smudge resistant, and therefore, are of excellent resolution; and further, such toner compositions can be selected for high speed electrophotographic apparatuses, that is those exceeding 70 copies per minute.

Also, in another object of the present invention there are provided developer compositions comprised of toner and carrier particles.

Additionally, in another object of the present invention there are provided processes for the preparation of unsaturated polyesterimides by the reaction of a dianhyride, an unsaturated monoanhydride, and an alkylene oxide diamime, such as a JEFFAMINE TM, followed by crosslinking utilizing, for example, reactive extrusion as illustrated in U.S. Pat. No. 5,376,494 and U.S. Pat. No. 5,227,460 (D/91117Q), the disclosures of which are totally incorporated herein by reference.

These and other objects of the present invention can be accomplished in embodiments thereof by providing toner compositions comprised of crosslinked polyesterimides, pigment particles and optional known toner additives.

The unsaturated polyesterimide resins of the present invention can be prepared as illustrated herein, that is for example by melt condensation methods. More specifically, there can be charged into a reactor equipped with a bottom drain valve, double turbine agitator and distillation receiver with a cold water condenser from about 0.75 to about 0.95 mole of monomer, such as trimellitic anhydride or 1,2,4-benzene tetracarboxylic acid, 0.45 to about 0.5 mole of flexible diamine, such as diamino terminated polyoxypropylene available as JEFFAMINE 230 TM from Texaco Chemicals, 0.0001 mole to about 0.02 mole of a polycondensation catalyst, such as butyltin oxide hydroxide, 0.95 to about 1.0 mole of a diol, such as ethanediol or 1,2-propanediol, and of from about 0.05 to about 0.25 mole of unsaturated monomer such as maleic acid, maleic anhydride or fumaric acid. The reactor is then heated to about 150° C. to about 190° C. with stirring for a duration of about 3 hours whereby 0.5 to about 0.9 mole of water byproduct is collected in the distillation receiver. The mixture is then heated to from about 180° to about 200° C., after which the pressure is slowly reduced from atmospheric pressure to about 1.0 millibar over a period of from about one hour to about 5 hour period with collection of approximately 0.45 to about 0.5 mole of glycol in the distillation receiver. The reactor is then purged with nitrogen to atmospheric pressure, and the resulting unsaturated polyesterimide, copoly(4-oxycarbonyl-1,2-phthalimido-ethyloxyethyl -1',2'-phthalimido-4'-carbonyl)copoly (oxycarbonyl-vinylidine-carbonyloxyethylene), is collected through the bottom drain valve. The glass transition temperature of the resin can then be measured and was, for example, from about 45° C. to about 65° C. (onset) utilizing the 910 Differential Scanning Calorimeter available from E. I. DuPont operating at a heating rate of 10° C. per minute. The number average molecular weight can be measured to be of from about 1,500 grams per mole to about 100,000 grams per mole by vapor phase calorimetry. The crosslinked polyesterimide resins of the present invention can be prepared as illustrated herein, that is for example by admixing and heating of from about 0.94 to about 0.999 mole percent of the aforementioned unsaturated polyesterimide with from about 0.001 mole percent to about 6 mole percent of an organo peroxide, such as benzoyl peroxide or lauryl peroxide, in a melt mixer or extruder at a temperature of from about 110° C. to about 190° C. for a duration of from about 1 minute to about 90 minutes. Generally, the crosslinked polyesterimides are prepared by the reaction of an unsaturated polyesterimide with a free radical initiator.

Specific examples of unsaturated polyesterimide resins include copoly(4-oxycarbonyl-1,2-phthalimidooethyloxyethyl-1',2'-phthalimido-4'-carbonyl) -copoly(oxycarbonyl-vinylidine-carbonyloxypropylene), copoly(4-oxycarbonyl -1,2-phthalimido-ethyloxyethyl-1',2'-phthalimido-4'-carbonyl)copoly (oxycarbonyl-vinylidine-carbonyloxyethylene), copoly(4-oxycarbonyl -1,2-phthalimido-ethyloxyethyloxyethyl-1',2'-phthalimido-4'-carbonyl) -copoly(oxycarbonyl-vinylidine-carbonyloxypropylene), copoly(4-oxycarbonyl -1,2-phthalimido-ethyloxyethyloxyethyloxyethyl-1',2'-phthalimido -4'-carbonyl)-copoly(oxycarbonyl-vinylidinecarbonyloxypropylene), copoly(4-oxycarbonyl-1,2-phthalimidopropyloxypropyloxypropyloxypropyl -1',2'-phthalimido-4'-carbonyl)copoly (oxycarbonyl-vinylidine-carbonyloxypropylene), mixtures thereof, and the like, which resin is present in various effective amounts, such as from about 85 percent by weight to about 98 percent by weight of the toner comprised of, for example, resin and pigment.

Specific examples of triacid or acid-anhydride monomers that can be utilized to prepare the unsaturated polyesterimide include trimellitic anhydride, 1,2,4 benzenetricarboxylic acid and the like selected in an amount of from about 0.40 to about 0.5 mole equivalent, or preferably in an amount of from about 0.4 to about 0.475 mole equivalent of the unsaturated polyesterimide.

Specific examples of diamino alkanes or diamino alkylene oxides that can be utilized to prepare the polyimide include diaminoethane, diaminopropane, 2,3-diaminopropane, diaminobutane, diaminopentane, diamino-2-methylpentane also known as DYTEK A TM available from E. I. DuPont Chemical Company, diaminohexane, diamino-trimethylhexane, diaminoheptane, diaminooctane, diaminononane, diaminodecane, diaminododecane, diaminoterminated-ethylene oxide, diaminoterminated-diethylene oxide available as JEFFAMINE EDR-148 TM from Texaco Chemicals, diaminoterminated-diethylene oxide available as JEFFAMINE EDR-148 TM from Texaco Chemicals, diaminoterminated-triethylene oxide available as JEFFAMINE EDR-192 TM from Texaco Chemicals, diaminoterminated-polyoxypropylene oxide available as JEFFAMINE D-230 TM, JEFFAMINE 400 TM, JEFFAMINE 700 TM all available from Texaco Chemicals, mixtures thereof, and the like, and selected in various effective amounts, such as from about 0.4 mole equivalent to about 0.6 mole equivalent, or preferably from about 0.45 to about 0.55 mole equivalent of unsaturated polyimide resin.

Specific examples of unsaturated monomers utilized to form the unsaturated polyesterimide include maleic anhydride, fumaric acid, maleic acid, itaconic acid, 2-methylitaconic acid, diesters of fumarate, maleate, itaconate wherein the alkyl chain of the diester contains from 1 carbon to about 23 carbon atoms, mixtures thereof, and the like, and employed in various effective amounts of, for example, from about 0.05 mole percent to about 0.2 mole equivalent, or preferably of from about 0.1 to about 0.15 mole equivalent of the unsaturated polyesterimide.

Specific examples of diol monomers utilized to form the unsaturated polyesterimide include ethanediol, propanediol, 1,2-propanediol, 1,4-butanediol, 2,4-butanediol, 3,4-butanediol, 1,5-pentanediol, 2,5-pentanediol, 3,5-pentanediol, 2,3-butanediol, 2,2-dimethyl-1,3-propanediol, 2-methyl-1,3-propanediol, neopentyl glycol, hexanediol, heptanediol, octanediol, nonanediol, decanediol, mixtures thereof, and the like selected in various effective amounts such as, for example, from about 0.4 to about 0.6 mole equivalent, and preferably from about 0.45 to about 0.55 mole equivalent of the unsaturated polyesterimide.

Specific examples of free radical initiators selected for polymerizing the unsaturated polyesterimide to enable the crosslinked polyesterimides include azo-type initiators such as 2-2'-azobis(dimethylvaleronitrile), azobis(isobutyronitrile), azobis(cyclohexane-nitrile), azobis(methyl-butyronitrile), mixtures thereof, and the like; peroxide initiators such as benzoyl peroxide, lauroyl peroxide, methyl ethyl ketone peroxide, isopropyl peroxy-carbonate, 2,5-dimethyl-2,5-bis(2-ethylhexanoyl-peroxy)hexane, di-tert-butyl peroxide, cumene hydroperoxide, dichlorobenzoyl peroxide; potassium persulfate, ammonium persulfate, sodium bisulfate, mixtures of potassium persulfate and sodium bisulfite, and mixtures thereof with the effective quantity of initiator selected being, for example, from about 0.1 percent to about 10 percent by weight of crosslinked polyesterimide resin.

A number of known colorants can be selected, which colorants are present in the toner in an effective amount of, for example, from about 1 to about 25 percent by weight of toner, and preferably in an amount of from about 1 to about 10 weight percent. Typical colorants include carbon black, like REGAL 330 ®magnetites, such as Mobay magnetites MO8029 TM, MO8060: TM; Columbian magnetites; MAPICO BLACKS TM and surface treated magnetites; Pfizer magnetites CB4799 TM, CB5300 TM, CB5600 TM, MCX6369 TM; Bayer magnetites BAYFERROX 8600 TM, 8610 TM; Northern Pigments magnetites NP-604 TM, NP-608 TM; Magnox magnetites TMB-100 TM, or TMB- 104 TM; and other equivalent black pigments. As colored pigments there can be selected known cyan, magenta, yellow, red, green, brown, blue or mixtures thereof. Specific examples of pigments include HELIOGEN BLUE L6900 TM, D6840 TM, D7080 TM, D7020 TM, PYLAM OIL BLUE TM and PYLAM OIL YELLOW TM, PIGMENT BLUE 1 TM available from Paul Uhlich & Company, Inc., PIGMENT VIOLET 1 TM, PIGMENT RED 48 TM, LEMON CHROME YELLOW DCC 1026 TM, E. D. TOLUIDINE RED TM and BON RED C TM available from Dominion Color Corporation, Ltd., Toronto, Ontario, NOVAperm YELLOW FGL TM, HOSTAPERM PINK E TM from Hoechst, and CINQUASIA MAGENTA TM available from E. I. DuPont de Nemours & Company, and the like. Generally, colored pigments that can be selected are cyan, magenta, or yellow pigments, and mixtures thereof. Examples of magenta materials that may be selected as pigments include, for example, 2,9-dimethyl-substituted quinacridone and anthraquinone dye identified in the Color Index as Cl 60710, Cl Dispersed Red 15, diazo dye identified in the Color Index as Cl 26050, Cl Solvent Red 19, and the like. Illustrative examples of cyan materials that may be used as pigments include copper tetra-(octadecyl sulfonamido) phthalocyanine, x-copper phthalocyanine pigment listed in the Color Index as Cl 74160, Cl Pigment Blue, and Anthrathrene Blue, identified in the Color Index as Cl 69810, Special Blue X-2137, and the like; while illustrative examples of yellow pigments that may be selected are diarylide yellow 3,3-dichlorobenzidene acetoacetanilides, a monoazo pigment identified in the Color Index as Cl 12700, Cl Solvent Yellow 16, a nitrophenyl amine sulfonamide identified in the Color index as Foron Yellow SE/GLN, Cl Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK TM and cyan components, may also be used as pigments, and are employed in effective amounts of from about 1 weight percent to about 65 weight percent of the toner.

The toner may also include known charge additives in various effective amounts such as from 0.1 to about 20, and preferably from about 1 to about 3 weight percent of the toner components such as alkyl pyridinium halides, bisulfates, the charge control additives of U.S. Pat. Nos. 3,944,493; 4,007,293; 4,079,014; 4,394,430, and 4,560,635 which illustrates a toner with a distearyl dimethyl ammonium methyl sulfate charge additive, the disclosures of which are totally incorporated herein by reference, and the like.

Surface additives that can be added to the toner compositions of the present invention include, for example, metal salts, metal salts of fatty acids, colloidal silicas, metal oxides, mixtures thereof, and the like, which additives are usually present in an amount of from about 0.1 to about 1 weight percent, reference U.S. Pat. Nos. 3,590,000; 3,720,617; 3,655,374 and 3,983,045, the disclosures of which are totally incorporated herein by reference. Preferred additives include zinc stearate and AEROSIL R972 ® available from DeGussa.

In another embodiment of the present invention, there are provided, subsequent to known micronization and classification, toner particles with an average volume diameter of from about 5 to about 20 microns comprised of the crosslinked polyesterimide resin, pigment particles, and optional charge enhancing additives. Also, the charge enhancing additives of the present invention may be coated on the pigment particle in an effective amount of from about 0.05 to about 5 weight percent of toner.

The toner and developer compositions of the present invention may be selected for use in electrostatographic imaging apparatuses containing therein conventional photoreceptors. Thus, the toner and developer compositions of the present invention can be used with layered photoconductive imaging members that are capable of being charged positively or negatively, such as those described in U.S. Pat. No. 4,265,990, the disclosure of which is totally incorporated herein by reference. Illustrative examples of inorganic photoreceptors that may be selected for imaging and printing processes include selenium ; selenium alloys, such as selenium arsenic, selenium tellurium and the like; halogen doped selenium substances; and halogen doped selenium alloys.

Examples of developers include admixtures of the toners, about 1 to about 3 parts per 100 parts of carrier. Examples of carriers include steel, ferrites, iron, coated or uncoated, which coatings include fluoropolymers like polyvinylflourides, terpolymers of styrene, methylmethacrylate, and an organo silane, and the like. Examples of carriers and coatings thereof are also illustrated in U.S. Pat. Nos. 4,937,166 and 4,935,326, the disclosures of which are totally incorporated herein by reference.

The following Examples are being supplied to further define various species of the present invention, it being noted that these Examples are intended to illustrate and not limit the scope of the present invention. Parts and percentages are by weight unless otherwise indicated.

EXAMPLE I

An unsaturated polyesterimide derived from trimellitic anhydride, fumaric acid, 1,2-propanediol, and diaminoterminatedpolyoxypropylene available as JEFFAMINE EDR-148 TM from Texaco Chemical Company was prepared as follows.

Trimellitic anhydride (172.8 grams), polyoxypropyldiamine (66.6 grams) available as JEFFAMINE EDR-148 TM from Texaco Chemicals, fumaric acid (18.4 grams), butyltin oxide hydroxide (0.3 grams) and 1,2-propanediol (122.5 grams) were charged in a 1 liter Parr reactor equipped with a double turbine agitator, bottom drain valve and distillation apparatus. The reaction mixture was heated to 190° C. over a 1 hour period, and maintained at this temperature for an additional 2 hours wherein 41.5 grams of distillant was collected in the distillation receiver. The pressure was then reduced from atmospheric pressure to about 50 millibars over a 30 minute period, and maintained under these conditions for an additional 45 minutes, followed by further decreasing the pressure to about 1 millibar over a 75 minute period, and maintained at these conditions for an additional 70 minutes, wherein an additional 60 grams of distillate was collected. The unsaturated polyesterimide, copoly(4-oxycarbonyl-1,2-phthalimido-ethyloxyethyloxyethyl -1',2'-phthalimido-4'-carbonyl)copoly (oxycarbonyl-vinylidine-carbonyloxypropylene), product was then discharged from the reactor through the bottom drain, and cooled uninterrupted to room temperature. The glass transition temperature of the polyesterimide was found to be 61.8° C. as measured by an E. I. DuPont Differential Scanning Calorimeter. The number average molecular weight was found to be 3,804 grams per mole, and the weight average molecular weight was found to be 9,215 grams per mole, both measured by Gel Permeation Chromatography.

EXAMPLE II

A crosslinked polyesterimide derived from 0.5 percent by weight of benzoyl peroxide and 99.5 percent by weight of the unsaturated polyesterimide of Example I was prepared as follows.

The unsaturated polyesterimide (59.7 grams) of Example I and 0.3 gram of benzoyl peroxide, available as LUCIDOL L-78 TM from Penwalt Chemicals, was admixed in a Haake melt mixer at 160° C. for a duration of 15 minutes. The crosslinked polyesterimide resin, crosslinked copoly(4-oxycarbonyl -1,2-phthalimido-ethyloxyethyloxyethyl-1',2'-phthalimido-4'-carbonyl) -copoly(oxycarbonyl-vinylidine-carbonyloxypropylene), was then collected and cooled to room temperature. The glass transition temperature of the aforementioned crosslinked polyesterimide was found to be 59.6° C. as measured by the E. I. DuPont Differential Scanning Calorimeter.

EXAMPLE III

A crosslinked polyesterimide derived from 0.8 percent by weight of benzoyl peroxide and 99.2 percent by weight of the unsaturated polyesterimide of Example I was prepared as follows.

The unsaturated polyesterimide (59.52 grams) of Example I and 0.48 gram of benzoyl peroxide available as LUCIDOL L-78 TM from Penwalt Chemicals was admixed in a Haake melt mixer at 160° C. for a duration of 15 minutes. The crosslinked polyesterimide resin, crosslinked copoly(4-oxycarbonyl -1,2-phthalimido-ethyloxyethyloxyethyl-1',2'-phthalimido-4'-carbonyl) -copoly-(oxycarbonyl-vinylidine-carbonyloxypropylene), was then collected and cooled to room temperature. The glass transition temperature of the aforementioned crosslinked polyesterimide was found to be 59.0° C. as measured by the E. I. DuPont Differential Scanning Calorimeter.

EXAMPLE IV

A crosslinked polyesterimide derived from 1.0 percent by weight of benzoyl peroxide and 99 percent by weight of the unsaturated polyesterimide of Example ]: was prepared as follows.

The unsaturated polyesterimide (59.4 grams) of Example I and 0.60 gram of benzoyl peroxide available as LUCIDOL L-78 TM from Penwalt Chemicals was admixed in a Haake melt mixer at 160° C. for a duration of 15 minutes. The crosslinked polyesterimide resin, copoly(4-oxycarbonyl-1,2-phthalimido -ethyloxyethyloxyethyl-1,2'-phthalimido-4'-carbonyl)copoly (oxycarbonyl-vinylidine-carbonyloxypropylene), was then collected and cooled to room temperature. The glass transition temperature of the aforementioned crosslinked polyesterimide was found to be 59.1° C. as measured by the E. I. DuPont Differential Scanning Calorimeter.

EXAMPLE V

A crosslinked polyesterimide derived from 1.5 percent by weight of benzoyl peroxide and 98.5 percent by weight of the unsaturated polyesterimide of Example I was prepared as follows.

The unsaturated polyesterimide (59.1 grams) of Example I and 0.90 gram of benzoyl peroxide available as LUCIDOL L-78 TM from Penwalt Chemicals was admixed in a Haake melt mixer at 160° C. for a duration of 15 minutes. The crosslinked polyesterimide resin, copoly(4-oxycarbonyl-1,2-phthalimido -ethyloxyethyloxyethyl-1',2'-phthalimido-4'-carbonyl)copoly (oxycarbonyl-vinylidine-carbonyloxypropylene), was then collected and cooled to room temperature, about 25° C., throughout unless otherwise indicated. The glass transition temperature of the aforementioned crosslinked polyesterimide was found to be 62.4° C. as measured by the E. I. DuPont Differential Scanning Calorimeter.

EXAMPLE VI

A crosslinked polyesterimide derived from 3.0 percent by weight of benzoyl peroxide and 97 percent by weight of the unsaturated polyesterimide of Example I was prepared as follows.

The unsaturated polyesterimide (58.2 grams) of Example I and 1.80 grams of benzoyl peroxide available as LUCIDOL L-78 TM from Penwalt Chemicals was admixed in a Haake melt mixer at 160° C. for a duration of 15 minutes. The crosslinked polyesterimide resin, copoly(4-oxycarbonyl-1,2-phthalimido -ethyloxyethyloxyethyl-1',2'-phthalimido-4'-carbonyl)copoly (oxycarbonyl-vinylidine-carbonyloxypropylene), was then collected and cooled to room temperature. The glass transition temperature of the aforementioned crosslinked polyesterimide was found to be 60.6° C. as measured by the E. I. DuPont Differential Scanning Calorimeter.

EXAMPLE VII

A black toner composition comprised of 94 percent by weight of the crosslinked polyesterimide resin of Example II and 6 percent by weight of REGAL 330 ® black pigment was prepared as follows.

The crosslinked polyesterimide resin of Example II was in the form of granules and ground to smaller particles utilizing a Black and Decker Coffee Grinder. After grinding, 50 grams (94 percent by weight of toner) of the crosslinked resin polymer was mixed with 3.2 grams of REGAL 330 ®pigment (6 percent by weight of toner). The two components were mixed utilizing a Black and Decker Coffee Grinder. The mixed components were then extruded utilizing the CS-194A twin screw extruder available from Custom Scientific Instruments at a barrel temperature of 140° C. An 8 inch 5turtevant micronizer was used to reduce the particle size further. After grinding, the toner was measured to display an average volume diameter particle size of 7.7 microns with a geometric distribution of 1.42 as measured by the Coulter Counter. A developer composition was prepared by roll milling the aforementioned toner, 3 parts by weight with 100 parts by weight of carrier comprised of a steel core with polyvinylidenefluoride polymer coating thereof, 0.75 weight percent coating and with an average diameter of about 90 microns, which carrier is available from Xerox Corporation. The tribo data was obtained using the known blow-off Faraday Cage apparatus, and the toner developer was subjected to 20 percent humidity in a chamber for 48 hours, and at 80 percent humidity level in a chamber for 48 hours. The ratio of the corresponding triboelectric charge at 20 percent RH to 80 percent RH as given by equation 1 was measured to be 0.95. Unfused copies were then produced with the above toner using a Xerox Corporation 1075 imaging apparatus with the fusing system disabled. The unfused copies were then subsequently fused on the 1075 fuser using a process speed of 11.9 inches per second. Fusing evaluation of the toner indicated a minimum fixing temperature of about 141°

C., and a hot-offset temperature of 180° C. The gloss of the solid area images were subsequently measured by a Gardner Gloss metering unit and found to display a gloss of 4 indicative of a matte finish.

EXAMPLE VIII

A black toner composition comprised of 94 percent by weight of the crosslinked polyesterimide resin of Example IV and 6 percent by weight of REGAL 330® black pigment was prepared as follows.

The crosslinked polyesterimide resin of Example IV was in the form of granules and ground to smaller particles utilizing a Black and Decker Coffee Grinder. After grinding, 50 grams (94 percent by weight of toner) of the crosslinked polymer was mixed with 3.2 grams of REGAL 330® pigment (6 percent by weight of toner). The two components were mixed utilizing a Black and Decker Coffee Grinder. The mixed components were then extruded utilizing the CS-194A twin screw extruder available from Custom Scientific Instruments at a barrel temperature of 140° C. An 8 inch Sturtevant micronizer was used to reduce the particle size further. After grinding, the toner was measured to display an average volume diameter particle size of 7.4 microns with a geometric distribution of 1.45 as measured by the Coulter Counter. A developer composition was prepared by roll milling the aforementioned toner, 3 parts by weight, with 100 parts by weight of carrier comprised of a steel core with polyvinylidenefluoride polymer coating thereof, 0.75 weight percent coating, and with an average diameter of about 90 microns, which carrier is available from Xerox Corporation. The tribo data was obtained using the known blow-off Faraday Cage apparatus, and the toner developer was subjected to 20 percent humidity in a chamber for 48 hours, and at 80 percent humidity level in a chamber for 48 hours. The ratio of the corresponding triboelectric charge at 20 percent RH to 80 percent RH was measured to be 1.95. Unfused copies were then produced with the above toner using a Xerox Corporation 1075 imaging apparatus with the fusing system disabled. The unfused copies were then subsequently fused on the 1075 fuser using a process speed of 11.9 inches per second. Fusing evaluation of the toner indicated a minimum fixing temperature of about 161° C., and hot-offset temperature of 180° C. The gloss of the solid area images were subsequently measured by a Gardner Gloss metering unit and found to display a gloss of 6 indicative of a matte finish.

Other embodiments and modifications of the present invention may occur to those skilled in the art subsequent to a review of the information presented herein; these embodiments and modifications, as well as equivalents thereof, are also included within the scope of this invention.

What is claimed is:

1. A toner composition comprised of a pigment, and a crosslinked polyesterimide, and which toner possesses a low fixing temperature of from about 130° C. to about 152° C. and a broad fusing latitude of from about 20° C. to about 80° C., and wherein the glass transition temperature thereof is from about 50° C. to about 65° C., and the relative humidity sensitivity is from about 1 to about 2.5.

2. A toner in accordance with claim 1 wherein the crosslinked polyesterimide is obtained from the reaction of a free radical initiator and an unsaturated polyesterimide.

3. A toner in accordance with claim 2 wherein the unsaturated polyesterimide is of the formula

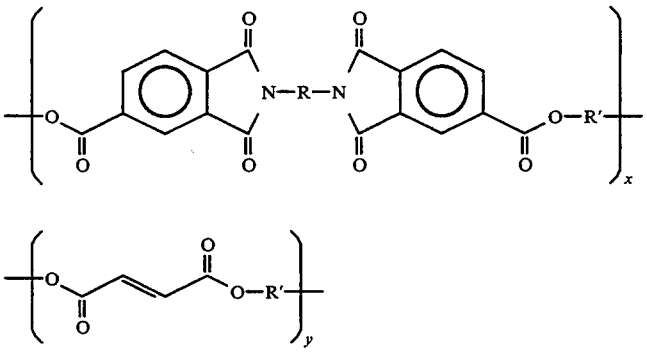

wherein x and y represent the number of random monomer segments present and is a number of from about 10 to about about 10,000; R' is an alkyl group and R is an alkyl, an oxyalkylene or a polyoxyalkylene.

4. A toner in accordance with claim 3 wherein R' is an alkyl with from 1 to about 23 carbon atoms, and preferably from about 2 to about 6 carbon atoms.

5. A toner in accordance with claim 3 wherein R' is methyl, ethyl, propyl, butyl, pentyl, hexyl, heptyl, octyl, nonyl, decyl, undecyl, dodecyl, stearyl, lauryl, or mixtures thereof.

6. A toner in accordance with claim 3 wherein R is the alkyl group selected from ethyl, propyl, butyl, pentyl, 2-methylpentyl, hexyl, heptyl, octyl, nonyl, decyl, undecyl, dodecyl, stearyl, or the oxyalkylene, diethylene oxide, triethylene oxide, tetraethylene oxide, pentahexylene, butylene oxide, pentylene oxide, polyethyleneoxide, dipropylene oxide, tripropylene oxide, tetrapropylene oxide, pentapropylene oxide, and polypropylene oxide.

7. A toner in accordance with claim 2 wherein the number average molecular weight of said polyesterimide is from about 3,000 to about 100,000 grams per mole and the weight average molecular weight is from about 20,000 to about 300,000 grams per mole.

8. A toner in accordance with claim 2 wherein the free radical initiator is a peroxide selected from benzoyl peroxide, lauroyl peroxide, methyl ethyl ketone peroxide, isopropyl peroxy-carbonate, 2,5-dimethyl-2,5-bis(2-ethylhexanoyl-peroxy)hexane, di-tert-butyl peroxide, cumene hydroperoxide, dichlorobenzoyl peroxide, potassium persulfate, ammonium persulfate, sodium bisulfite, and mixtures of potassium persulfate and sodium bisulfite, which peroxide is selected in an amount of from about 0.5 percent to about 5 percent by weight of unsaturated polyimide.

9. A toner in accordance with claim 3 which possesses a low fixing temperature of from about 130° C. to about 162° C. and a broad fusing latitude of from about 20° C. to about 80° C.

10. A toner composition in accordance with claim 3 wherein the glass transition temperature thereof is from about 50° C. to about 65° C.

11. A toner composition in accordance with claim 3 with a relative humidity sensitivity of from about 1.01 to about 2.5.

12. A toner composition in accordance with claim 1 further including a charge enhancing additive incorporated into the toner, or present on the surface of the toner.

13. A toner in accordance with claim 2 wherein the unsaturated polyimide is selected from the group consisting copoly(4-oxycarbonyl -1,2-phthalimido-ethyloxyethyl-1',2'-phthalimido-4'-carbonyl)copoly (oxycarbonyl-vinylidine-carbonyloxypropylene), copoly(4-oxycarbonyl -1,2-phthalimido-ethyloxyethyl-1',2'-phthalimido-4'-carbonyl)copoly (oxycarbonyl-vinylidine-carbonyloxyethylene), copoly(4-oxycarbonyl -1,2-phthalimido-ethyloxyethyloxyethyl-1',2'-phthalimido-4'-carbonyl) -copoly(oxycarbonyl-vinylidine-carbonyloxypropylene), copoly(4-oxycarbonyl -1,2-phthalimido-ethyloxyethyloxyethyloxyethyl-1',2'-phthalimido -4'-carbonyl)-copoly(oxycarbonyl-vinylidinecarbonyloxypropylene), copoly(4-oxycarbonyl-1,2-phthalimidopropyloxypropyloxypropyloxypropyl -1',2'-phthalimido-4'-carbonyl)copoly (oxycarbonyl-vinylidine-carbonyloxypropylene), and mixtures thereof.

14. A toner in accordance with claim 1 wherein the crosslinked polyesterimide is selected from the group consisting of crosslinked copoly(4-oxycarbonyl-1,2-phthalimido-ethyloxyethyl-1',2'-phthalimido-4'-carbonyl) -copoly(oxycarbonyl-vinylidine-carbonyloxypropylene), crosslinked copoly(4-oxycarbonyl-1,2-phthalimido-ethyloxyethyl-1',2'-phthalimido -4'-carbonyl)-copoly(oxycarbonyl-vinylidinecarbonyloxyethylene), crosslinked copoly(4-oxycarbonyl-1,2-pthalimidoethyloxyethyloxyethyl -1',2'-phthalimido-4'-carbonyl)-copoly(oxycarbonylvinylidine-carbonyloxypropylene), crosslinked copoly(4-oxycarbonyl-1,2-phthalimido -ethyloxyethyloxyethyloxyethyl-1',2'-phthalimido-4'-carbonyl)copoly (oxycarbonyl-vinylidine-carbonyloxypropylene), crosslinked copoly(4-oxycarbonyl-1,2-phthalimidopropyloxypropyloxypropyloxypropyl -1',2'-phthalimido-4'-carbonyl)-copoly(oxycarbonyl-vinylidine-carbonyloxypropylene), and mixtures thereof.

15. A toner in accordance with claim 2 wherein the crosslinked polyesterimide is obtained from the reaction of from about 0.96 mole equivalent to about 0.995 mole equivalent of unsaturated polyesterimide, and from about 0.005 mole equivalent to about 0.05 mole equivalent of free radical initiator.

16. A toner composition in accordance with claim 1 further containing as external additives metal salts of a fatty acid, colloidal silicas, or mixtures thereof.

17. A toner composition in accordance with claim 1 wherein the pigment is carbon black, magnetites, or mixtures thereof, cyan, magenta, yellow, red, blue, green, brown, or mixtures thereof.

18. A developer composition comprised of the toner composition of claim 1 and carrier particles.

19. A developer composition in accordance with claim 1 wherein the carrier particles are comprised of ferrites, steel, or an iron powder with an optional coating, or mixture of coatings.

20. A method of imaging which comprises formulating an electrostatic latent image on a negatively charged photoreceptor, affecting development thereof with the toner composition of claim 1, and thereafter transferring the developed image to a suitable substrate.

21. A method in accordance with claim 20 wherein the gloss of the image is from about 1 to about 30 gloss units.

22. A method in accordance with claim 20 wherein the developed image is matte.

* * * * *